US006368001B1

(12) United States Patent
Roeder

(10) Patent No.: US 6,368,001 B1
(45) Date of Patent: Apr. 9, 2002

(54) PENCIL

(75) Inventor: Georg Roeder, Schwabach (DE)

(73) Assignee: Schwan-STABILO Cosmetics GmbH + Co., Heroldsberg (DE)

( * ) Notice: Subject to any disclaimer, the term of this patent is extended or adjusted under 35 U.S.C. 154(b) by 0 days.

(21) Appl. No.: 09/744,791

(22) PCT Filed: Feb. 10, 2000

(86) PCT No.: PCT/EP00/01087

§ 371 Date: Feb. 1, 2001

§ 102(e) Date: Feb. 1, 2001

(87) PCT Pub. No.: WO00/47080

PCT Pub. Date: Aug. 17, 2000

(30) Foreign Application Priority Data

Feb. 11, 1999 (DE) ..... 199 05 723

(51) Int. Cl.[7] ..... B43K 27/00
(52) U.S. Cl. ..... 401/31
(58) Field of Search ..... 401/29, 31, 89, 401/98

(56) References Cited

U.S. PATENT DOCUMENTS 5,306,107 A * 4/1994 Kageyama et al. ..... 401/29

FOREIGN PATENT DOCUMENTS

EP 0 492 266 7/1992

* cited by examiner

*Primary Examiner*—Gregory L. Huson
*Assistant Examiner*—Peyer deVore
(74) *Attorney, Agent, or Firm*—Bachman & LaPointe, P.C.

(57) ABSTRACT

Described is a pencil with two refills at mutually opposite ends. Both refills are axially displaceable. Adjusting spindles respectively serve for axial displacement, of which a first adjusting spindle is tubular and there is at least one first operating position in which the second adjusting spindle projects with its end remote from the second refill into the first adjusting spindle. According to the invention it is provided that there is at least one second operating position in which the second adjusting spindle does not project with its end remote from the second refill into the first adjusting spindle. There is also provided a guide means which is not identical to the first adjusting spindle, for preventing the end, remote from the second refill, of the second adjusting spindle from tilting transversely with respect to the axial direction at least in the second operating position.

5 Claims, 1 Drawing Sheet

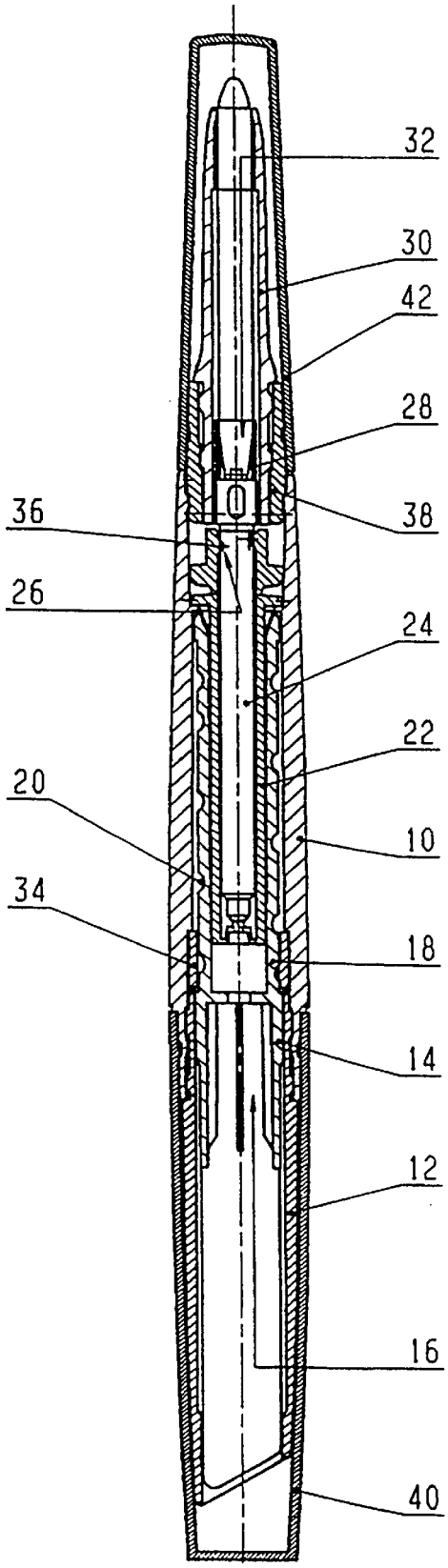
32
30
42
28
36
38
26
24
22
20
10
34
18
14
12
16
40

PENCIL

The invention concerns a pencil having a holding barrel with two ends, a first adjusting sleeve which is held at a first end of the holding barrel in such a way that it can be rotated with respect to the holding barrel, a first refill which is coupled to the first adjusting sleeve by means of a first transmission means having the first adjusting spindle, in such a way that it is displaced upon rotation of the first adjusting sleeve with respect to the holding barrel in the axial direction of the first adjusting sleeve, a second adjusting sleeve which is held at a second end of the holding barrel in such a way that it can be rotated with respect to the holding barrel, and a second refill which is coupled to the second adjusting sleeve by means of a second transmission means having a second adjusting spindle, in such a way that it is displaced upon rotation of the second adjusting sleeve with respect to the holding barrel in the axial direction of the second adjusting sleeve, wherein the first adjusting spindle is tubular and there is at least one first operating position in which the second adjusting spindle projects with its end remote from the second refill into the first adjusting spindle.

Pencils of the kind set forth in the opening part of this specification are known, for example from EP 0 492 266 B1. They may involve for example cosmetic pencils. It will be appreciated however that they may also be pencils or crayons for other purposes, such as for example writing, drawing, painting or marking. The applicator elements arranged at the free ends of the sticks or refills can be of any desired configuration and can be held in any manner. It is for example also possible to use sticks or refills with applicator elements for writing fluids as well as solid refills or sticks.

A problem which arises with the known pencils is that the second adjusting spindle is not reliably supported and guided at its end remote from the second refill, when the second adjusting spindle does not project into the first adjusting spindle. That is the case in particular when both adjusting spindles or refills are displaced outwardly beyond a certain amount.

Admittedly it is theoretically possible to limit the maximum displacement of the two adjusting spindles or refills to an amount such that the second adjusting spindle still just projects into the first adjusting spindle. Limiting the travel in that way however would involve a corresponding limitation on the refill length and thus the refill mass, in particular when using self-consuming refills.

Accordingly the object of the present invention is to improve a pencil of the kind set forth in the opening part of this specification, such as to ensure that the second adjusting spindle is reliably guided or held without correspondingly limiting the maximum refill length.

In accordance with the invention that object is attained in that there is at least one second operating position in which the second adjusting spindle does not project with its end remote from the second refill into the first adjusting spindle, and there is provided a guide means which is not identical to the first adjusting spindle for preventing the end of the second adjusting spindle, which is remote from the second refill, from tilting transversely with respect to the axial direction at least in the second operating position.

In other words, in accordance with the invention the two adjusting spindles or the two refills or sticks can be extended to such an extent, more specifically into the second operating position referred to above, that the second adjusting spindle no longer projects into the first adjusting spindle. Nonetheless, tilting of the end of the second adjusting spindle, which is remote from the second refill, transversely with respect to the axial direction, is prevented, even if not by the first adjusting spindle. On the contrary a separate guide means is provided for that purpose.

In that way the amount by which the two refills are extended is no longer limited by the need to prevent the second adjusting spindle from tilting as referred to above, by means of the first adjusting spindle. Nonetheless tilting is reliably prevented, more specifically by virtue of the guide means.

In accordance with the invention it is preferably provided that the guide means prevents the end, remote from the second refill, of the second adjusting spindle from tilting transversely with respect to the axial direction, in each operating position. In other words, it is admittedly provided that the second adjusting spindle projects into the first adjusting spindle, at least in the first operating position. In that case however the second adjusting spindle does not prevent the first adjusting spindle from tilting transversely with respect to the axial direction. The guide means is preferably provided in accordance with the invention for that purpose.

It will be appreciated that the end of the first adjusting spindle, that is remote from the first refill, can be prevented from tilting transversely with respect to the axial direction. It is preferably provided in accordance with the invention however that the guide means prevents the end, remote from the first refill, of the first adjusting spindle from tilting transversely with respect to the axial direction, in each operating position. That prevention action can be provided as an alternative to or in addition to other prevention actions.

The guide means can in principle be of any desired configuration. Preferably in accordance with the invention however it is in the form of a sleeve. In that arrangement, the sleeve accommodates on the one hand the second adjusting spindle while on the other hand it is itself accommodated by the first adjusting spindle. In that way it can prevent both adjusting spindles from tilting transversely with respect to the axial direction.

Preferably the guide sleeve is closed at its end remote from the second refill. In that way, for example the two refills can be kept separated from each other in liquid-tight and gas-tight relationship, which is advantageous for example when one of the two refills contains a volatile component while the other refill is in powder form. In such a case more specifically there is a risk of the volatile component contaminating the powder.

The invention is described in greater detail hereinafter with further features thereof by means of a preferred embodiment with reference to the drawing in which:

The single FIGURE is a view in axial section of a preferred embodiment of the invention.

The double-refill or double-stick pencil shown in the drawing concerns a cosmetic pencil which, at the end shown downwardly in the drawing, has a refill or stick with a flat application region, that is to say for example a lipstick, while the refill or stick which is disposed upwardly in the drawing is a stick or refill which rather converges to a point or tip, for example a liner.

The illustrated pencil has a holding barrel 10 into which a first adjusting sleeve 12 is fitted at the lower end. In this case the first adjusting sleeve 12 is admittedly held axially immovably with respect to the holding barrel 10 by suitable measures (for example a snap-action locking arrangement). It is however rotatable with respect to the holding barrel 10. Disposed within the first adjusting sleeve 12 is a first refill holder 14 having a first cavity 16 for receiving refill material (not shown). At its end which is upward in the drawing, the first refill holder 14 carries a first adjusting spindle 18 which is hollow and which carries a screwthread on its outside. Of the screwthread, a thread flight which is shown in section is identified by reference numeral 20.

A guide sleeve 22 projects into the first adjusting spindle 18. The first adjusting spindle 18 is held axially displaceably and rotatably with respect to the guide sleeve 22.

In its interior, the guide sleeve 22 accommodates a second adjusting spindle 24. The second adjusting spindle 24 is also held axially displaceably and rotatably with respect to the guide sleeve 22. On its outside peripheral surface the second adjusting spindle 24 has a screwthread of which a thread flight which is shown in section is identified by reference numeral 26. At its end which is shown upwardly in the drawing, the second adjusting spindle is rigidly connected to a second refill holder 28. The second refill holder 28 projects into a second adjusting sleeve 30. It has a second cavity 32 for receiving a stick or refill.

For co-operating with the above-mentioned external screwthreads on the two adjusting spindles, there are provided internally screwthreaded elements 34 and 36 which are non-rotatably and axially immovably coupled to the holding barrel 10.

In the embodiment illustrated in the drawing, the internally screwthreaded element 34 is produced in one piece together with the first adjusting sleeve 12, by injection molding. After the internally screwthreaded element 34 has been introduced into the end of the holding barrel 10, which is illustrated downwardly in the drawing, the first adjusting sleeve 12 is rotated with respect to the holding barrel 10. As the holding barrel 10, in the region of the internally screwthreaded element 34, and the internally screwthreaded element 34 itself, are each of a nonround contour, the internally screwthreaded element 34 cannot be rotated with respect to the holding barrel 10. On the contrary, it is rotated with the holding barrel 10 relative to the first adjusting sleeve 12 whereby the internally screwthreaded element 34 breaks away from the adjusting sleeve 12. A desired-rupture location is provided between those two component parts, for that purpose.

In the illustrated embodiment, the internally screwthreaded element 36 is formed in one piece with the guide sleeve 32. It is also produced in one piece with an intermediate sleeve 38. In this case, the internally screwthreaded element 36 is designed to be resilient in the radial direction. In the opened condition therefore the second adjusting spindle can be introduced into the internally screwthreaded element 36. It is only for the purposes of introducing the internally screwthreaded element 36 with the second adjusting spindle 24 fitting therein into the holding barrel 10, that the internally screwthreaded element 36 engages into the male screwthread provided on the second adjusting spindle.

The first refill holder 14 and the first adjusting sleeve 12 are admittedly non-rotatably coupled together, but they are axially displaceable relative to each other. The same applies for the second adjusting sleeve 30 and the second refill holder 28. Rotational couplings of that kind with at the same time axial displaceability are generally known, and for that reason they do not have to be described in detail here. For example, they can be embodied by means of non-round, interengaging contours.

A cap 40 and 42 respectively can be fitted on to both ends of the illustrated pencil in order to protect the respective sticks or refills, for example to prevent them from drying out.

A similar purpose is served by that feature whereby the guide sleeve 22 is closed at its end which is illustrated downwardly in the drawing. That prevents the two refills of the pencil from adversely affecting each other, for example by virtue of volatile constituents in the one refill contaminating the other. In addition, that configuration forms an abutment which limits axial displacement of the second adjusting spindle downwardly in the drawing.

Displacement of the refills takes place in the following manner, in the case of the embodiment illustrated in the drawing:

To displace the refill at the end which is downward in the drawing, the first adjusting sleeve 12 is rotated relative to the holding barrel 10. In that way, the first refill holder 14 which is connected to the first adjusting sleeve 12 also rotates, with the first adjusting spindle 18 mounted thereto. Due to the screwthreaded engagement of the internally screwthreaded element 34 which is non-rotatably connected to the holding barrel 10, in the above-mentioned rotary movement the first refill holder 14 and the first adjusting spindle 18 are displaced axially with respect to the holding barrel whereby the refill which is held by the first refill holder 14 can be displaced axially with respect to the holding barrel 10.

In a similar manner, axial displacement of the refill which is disposed at the upper end is effected by rotation of the second adjusting sleeve 30 with respect to the holding barrel 10. More specifically, with the second adjusting sleeve 30, the second refill holder 28 and the second adjusting spindle 24 also rotate, which by virtue of the screwthreaded engagement with the internally screwthreaded element 36 results in axial displacement of the second adjusting spindle 24 and the second refill holder 28 with the stick or refill held therein.

In the condition illustrated in the drawing, that is to say when both refills or sticks are completely retracted, the two adjusting spindles 18 and 24 are arranged in such a way that one extends into the other, thereby minimising the axial structural length of the overall pencil. When both refills are extended to the maximum degree, then in the drawing the lower end of the second adjusting spindle 24 is above the upper end of the first 25 adjusting spindle 18. In such a condition therefore the two adjusting spindles can no longer secure each other to prevent tilting transversely with respect to the axial direction. That securing function however is implemented by the guide sleeve 22 into which the second adjusting spindle 24 still extends in the above-indicated condition of maximum extension of the refills, while the first adjusting spindle 18 still just embraces the guide sleeve 28.

The features of the invention disclosed in the description, the claims and the drawing can be essential both individually and also in any combinations for carrying out the invention in its various embodiments.

What is claimed is:

1. A pencil comprising:

a holding barrel having a first end and a second end;

a first adjusting sleeve which is rotatably mounted on the first end of the holding barrel;

a first refill coupled to the first adjusting sleeve by first adjusting spindle means for displacing the first refill in an axial direction of the first adjusting sleeve upon rotation of the first adjusting sleeve with respect to the holding barrel;

a second adjusting sleeve which is rotatably mounted on the second end of the holding barrel;

a second refill coupled to the second adjusting sleeve by second adjusting spindle means for displacing the second refill in the axial direction upon rotation of the second adjusting sleeve with respect to the holding barrel;

the first adjusting spindle means has a tubular portion and the second adjusting spindle means has an end remote from the second refill which projects into the tubular portion in a first operating position and is removed from the tubular portion in a second operating position; and guide means extending at least partially between the first adjusting spindle means toward the second refill for preventing the end of the second adjusting spindle means remote from the second refill from tilting transversely with respect to the axial direction when in the second operating position.

2. A pencil as set forth in claim 1 wherein the guide means prevents the end, which is remote from the second refill, of the second adjusting spindle means from tilting transversely with respect to the axial direction in the first operating position.

3. A pencil as set forth in claim 1 wherein the guide means prevents the end, which is remote from the first refill, of the first adjusting spindle from tilting transversely with respect to the axial direction in both operating position.

4. A pencil as set forth in claim 1 wherein the guide means is in the form of a sleeve.

5. A pencil as set forth in claim 1 wherein the guide means is integral with the first adjusting spindle means.

* * * * *